United States Patent [19]

Scheiwiller

[11] 4,122,822

[45] Oct. 31, 1978

[54] SPRING TYPE APPARATUS FOR THE PROJECTING OF FOOTBALLS AND THE LIKE

[76] Inventor: Kurt Scheiwiller, 25 Wiesentalstrasse, 9242 Oberuzwil, Switzerland

[21] Appl. No.: 749,604

[22] Filed: Dec. 13, 1976

[30] Foreign Application Priority Data

Dec. 11, 1975 [CH] Switzerland ..... 16192/75

[51] Int. Cl.[2] ..... F41B 7/00

[52] U.S. Cl. ..... 124/54; 124/41 R; 124/36; 124/50

[58] Field of Search ..... 124/7, 36, 32, 41 R, 124/50, 81, 16, 49, 17, 54; 273/26 D, 29 A

[56] References Cited

U.S. PATENT DOCUMENTS

| | | | |
|---|---|---|---|
| 3,128,752 | 4/1964 | Andersen | 124/16 |
| 3,470,859 | 10/1969 | Donza | 124/36 X |
| 3,525,320 | 8/1970 | Dekan | 273/89 X |
| 3,610,223 | 10/1971 | Green | 124/50 |
| 4,015,578 | 4/1977 | Wright | 124/36 X |

*Primary Examiner*—Richard C. Pinkham
*Assistant Examiner*—William R. Browne
*Attorney, Agent, or Firm*—Larson, Taylor & Hinds

[57] ABSTRACT

Apparatus for projecting footballs. Footballs are placed in a football container transferred one at a time to a football shooting station. A striking force is applied to the football. The striking force is adjustable; and its point of impact against the football is selectable. Footballs can be projected in identical manner in quick succession. The lower end of the football striking member impacts against a football in the general area of the lowest point of the swinging movement of the football striking member.

16 Claims, 9 Drawing Figures

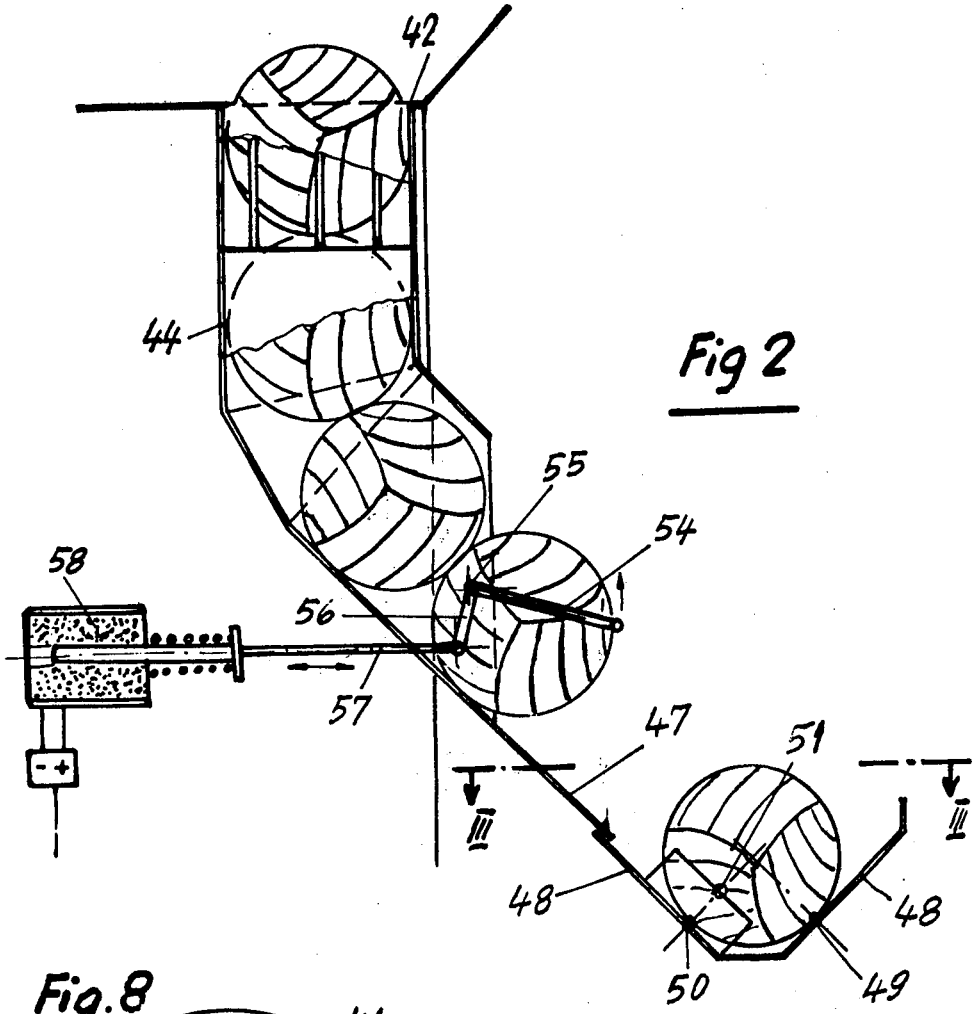
Fig 2
Fig.8
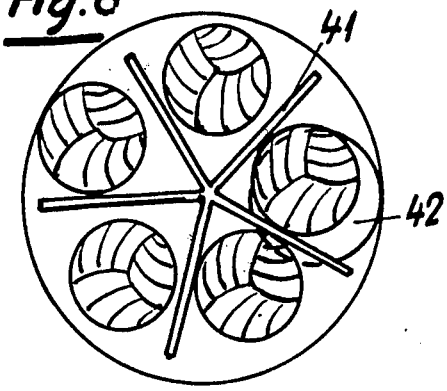
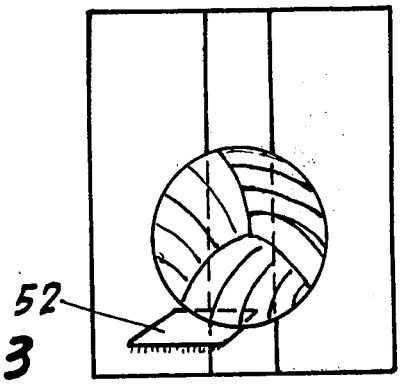
Fig 3

20
24
α
β

SPRING TYPE APPARATUS FOR THE PROJECTING OF FOOTBALLS AND THE LIKE

BACKGROUND OF THE INVENTION

The invention relates to a method and apparatus for the projecting or shooting of footballs and the like.

It is a fact at the present time that many footballers have reached such a high degree of skill that they must be regarded as true artists in their control of the ball.

Balls are delivered and received with the greatest precision both as regards direction and striking force, and are received with head, chest or feet. The balls sometimes have to be stopped and for example kicked directly to a part of the goal where the goalkeeper is not expecting a shot.

The main difficulty of the footballer is that he has to carry out the individual actions with lightning speed in the vicinity of one or more opponents, in order to achieve any success at all. Perhaps this is a crucial difference between football, and for example, tennis.

In tennis the opponent is away on the other side. The game consists of a to and fro between one player and the other. The tennis player has to be in action himself during the entire game and has to receive balls and strike them back at a very high rate of frequency. It could almost be said that the tennis player himself is a ball striking machine.

In contrast to the tennis player, the individual footballer has only a relatively few opportunities during a game to show his best pieces of artistry, as of course evidenced by the response of the spectators.

The footballer has basically all his body in action except that in the negative sense his arms and hands must keep away from the ball whereas in the positive sense his other active parts influence the ball. He must practise his best performance, and the control of his body and limbs.

As has been found at the present time, the tennis player has two possibilities. He practises with a partner of equal skill. A weaker partner is not much use to him since the other player loses almost at every shot. The tennis player therefore uses some kind of ball throwing apparatus as a second possibility.

The footballer only has one possibility. He practises in the team. Apart from professional footballers it is very often difficult or even impossible to collect suitable partners.

In very recent times many attempts have been made also to provide footballers with mechanical partners. But it is not surprising that all such attempts have failed, since a machine cannot be a partner in a football team, a game in which friend and foe follow literally on one another's heels.

STATEMENT OF PRIOR ART

Swiss Pat. No. 383,052 published on Mar. 15, 1965, in FIGS. 1 to 3 discloses a ball shooting apparatus pure and simple for a football.

It is to be assumed that with the shooting apparatus shown in FIG. 1 of that patent in the illustrated position it is in fact possible to project the ball even with a striking force which can be adjusted through several stages.

The hammer 10 there strikes horizontally exactly in a horizontal plane against the centre point of the ball. The horizontal kick or so-called "toe kick" is in fact used but only seldom. The balls are of different sizes, and even international rules allow deviations of up to 1 cm in diameter. If a particularly small football is placed on the projecting apparatus, therefore, the hammer strikes above the horizontal central plane. The result is a downwardly directed component of force so that depending on conditions, whether it is wet or dry, the ball begins to bounce and there are considerable deviations from the intended point of aim and even undesirable spinning of the ball.

Vertical adjustment of the entire apparatus as proposed in FIG. 4 of that patent is not a very practicable solution particularly for example for a long-range kick.

In order to adjust shooting angle according to that prior patent a shooting plate 1 is to be adjusted upwardly at an angle.

If the maximum possible inclined position of about 15° is assumed in FIG. 1, the hammer 10 must yield in a rearward direction. The hammer must do so to such an extent that the direction of the striking force is directly approximately at an angle of 30° obliquely to the shooting plate 1.

The proportion of the impact towards the shooting plate which is possible even with a horizontal kick is unavoidable to a very much greater extent with a normal cross shot. Thus the friction between ball and shooting plate becomes an important negative factor. It also must not be forgotten that the solution proposed in the prior patent deliberately excluded the automation of the sequences of movements, since the machine was deliverately given the function of a mechanical player for a type of game in which the ball is kicked to and fro.

SUMMARY OF THE INVENTION

According to one of its aspects the invention provides a method for shooting of footballs and the like comprising the steps of placing a plurality of said balls in a ball container, transferring said balls one at a time from said container to a ball shooting station, and applying to each said ball when at said shooting station a striking force which has been adjusted as regards its strength from within a range of different strengths and of which the point of impact against said ball has been selected from within a range of different points of impact, whereby said ball is projected in a selected direction with desired strength.

According to another aspect the invention provides an apparatus for shooting a football or the like comprising: a ball container adapted to contain a plurality of said balls, a ball shooting station, transfer means for the transfer of balls one at a time from said container to said shooting station, striking means adapted to strike said ball, adjustment means for adjusting the strength of the force with which said striking means strikes said ball, and position selection means for selecting the position of the point of impact of said striking force against said ball.

In specialised training, as far as possible, all techniques of the individual player should be practised in rapid succession so that great skill can be achieved in a very short time. The foregoing is made possible in large measure by the present invention.

It is an achievement of the present invention that it was recognised that the attempts made hitherto to find a mechanical partner for football training were directed at the wrong problem. In football the mechanical partner need not be the opponent but the own team player who kicks good balls towards the practising player to allow him to shoot towards a target with the highest degree of body control. Each individual movement sequence must be practised and only the countless repeats of the same patterns of movement coupled with the necessary talent can lead to the high standards of performance seen at the present day.

Although in retrospect it may seem obvious, it is in fact very surprising that it has only now been recognised that the footballer must base his practise on repetition when practising special techniques, the use of the head, stopping the ball, taking corners etc., so that when practising it may be necessary to obtain rates of frequency approximating to those usual in tennis, and, what is just as important in football training, it is necessary to be able to select the force of the shot.

It has been found that particularly good results are obtained if the individual method steps are taken over as faithfully as possible from the football player himself, or at least a technically equivalent solution is used.

It is advantageous if the direction of the striking force relatively to the football can be selected in a range between horizontal and directed obliquely upwards. It has been found particularly advantageous if the point of impact on the ball can be selected from within a range between a horizontal plane through the centre point of the ball and an angle of more than 15° below that plane.

It is possible that in some cases it will also be desirable to obtain a striking effect directed slightly towards the ground. But in practice by far the most frequent case will be a range between horizontal and about 45° below the horizontal. The striking force may be produced in any way. The best results were obtained if the striking force is produced mechanically by a striking bar formed from a material of inconsiderable mass such as for example wood or the like.

It is desirable to obtain a slightly resiliently yielding effect at the striking bar. It has been found particularly suitable to produce a striking force which is brought about by a striking bar which can swing in the manner of a clock pendulum and is preferably about the length of a human leg, i.e. 70cm to 100cm. The striking bar may be accelerated up to the point of impact against the ball and the actual striking force only then applied to the striking bar, and in this way the ball is followed-through by the striking bar for a slight distance, producing an actual after-pressure.

In the apparatus provided by the invention, the striking means preferably comprise a mechanically driven striking bar. In order that the point of impact of the striking means on the football and therefore the direction in which the ball is projected can be selected, it has been found to be best to adjust the height of the shooting station relatively to the striking means, more particularly relatively to the striking bar. The shooting station itself preferably comprises three support points which are all situated below a horizontal plane extending through the centre point of the ball. In this way, differences in ball diameter do not lead to any great change in the effective relative position of the impact point of the striking bar against the ball. The three supporting points are preferably adjusted in height along with the shooting station so that vertical adjustment of the mechanically moved striking bar can be avoided. This solution is simpler and more reliable. The important points for accuracy of aim include striking force, direction of striking, point of impact of the striking force on the ball, and the precise position of the ball relatively to the striking bar.

In order that the ball can be positioned precisely, it is advantageous to construct the shooting station with the three support points as a V-shaped channel inclined obliquely downwards towards the striking means. When the football is let down with the ball transfer means on to the inclined channel it is often unavoidable that the ball will bounce repeatedly. If the channel is inclined only to the extent of a few degrees and the supporting points are situated about 45° downwards from the centre point of the football, the ball strongly tends to move towards the striking bar and the third support point. In this way the ball itself tends to move into position on the shooting station.

In a particular constructional form, the V-shaped channel can be turned or displaced about a vertical axis at least through a small angle and in this way the shooting direction can also be selected in the horizontal plane at least to some extent. The ball shooting apparatus can also be mounted on a slewing ring or on wheels, and the entire arrangement turned to select the horizontal direction.

The striking bar is preferably of inconsiderable mass and made from a springly resilient material such as for example wood and the like.

Because of the low weight and the springy nature of the striking bar in conjunction with the elastic behaviour of the football, the impact has a follow-through effect.

Preferably the striking bar has a striking shoe at the outer end, the shoe being rounded in vertical projection towards the point of impact. In this way it is possible to keep to the intended point of impact with great precision.

It is interesting that with a wooden striking bar mounted for pivoting movement near its upper end, and about the length of a human leg, very good results were obtained almost straight away.

Preferably, the striking shoe is provided at the outer or lower end of the striking bar and the shooting station is disposed so as to be only slightly above the ground, the striking bar being mounted preferably at the upper end on a horizontal pivot pin. In this way "natural" shots are deliberately brought about.

A very similar result can be obtained if the striking bar is mounted at the inner end on a vertical pivot and the pivot can even be slightly inclined out of the vertical if appropriate. Here again the shooting station is preferably only slightly above the ground. In this way certain constructional advantages may be obtained.

Different ways are available for imparting the striking movement to the striking means. A simple solution (and thus far also believed to be best) is to provide the striking means with a motor-driven cam disc which can be brought into engagement with the striking bar preferably through the agency of a roller secured on the striking bar.

The cam disc produced the striking impact. The striking portion of the cam disc is formed by a straight preferably radially projecting, short, external end surface portion of the cam. A particularly intensive blow may be obtained if the surface portion deviates by less than 10°–15° from a radial line.

In a preferred embodiment the striking bar and the cam disc may be mounted with the pivoting axis of the striking bar and the axis of rotation of the cam disc parallel and so as to be capable of axial displacement relatively to one another for the purpose of allowing the cam disc to be continuously rotated, and a roller secured on the striking bar to be displaced into the turning circle of the cam disc for initiating an impact.

One of the main advantages of the cam disc resides in the fact that it is possible to vary the rotational speed in infinitely variable manner by means of an adjustable motor drive.

The revolutions of the cam disc can be adjusted in infinitely variable manner to produce different acceleration of the striking bar and thus an infinitely adjustable striking intensity.

The ball container may be mounted above the shooting station, and a connecting tube may be provided between the ball container and the shooting station.

Consequently the balls can pass from the ball container by gravitational force to the shooting station. The lower end of the connecting tube may have a controllable retaining device so that only one ball at a time is placed on the shooting station.

The ball container may have a floor which is substantially flat and continuous except for the opening to the connecting tube, and a short distance above the floor a preferably intermittently driven multi-part star-shaped element rotates for feeding footballs into the opening leading to the connecting tube.

BRIEF DESCRIPTION OF THE DRAWINGS

An embodiment of the invention will now be explained by way of example with reference to the accompanying drawings:

FIG. 2 shows a section on the line II—II of FIG. 1, FIG. 3 is a plan view as seen along the line III—III of FIG. 2, FIG. 8 is a plan view as seen along the line VIII—VIII of FIG. 1.

DESCRIPTION OF THE PREFERRED EMBODIMENT

Figure 1:
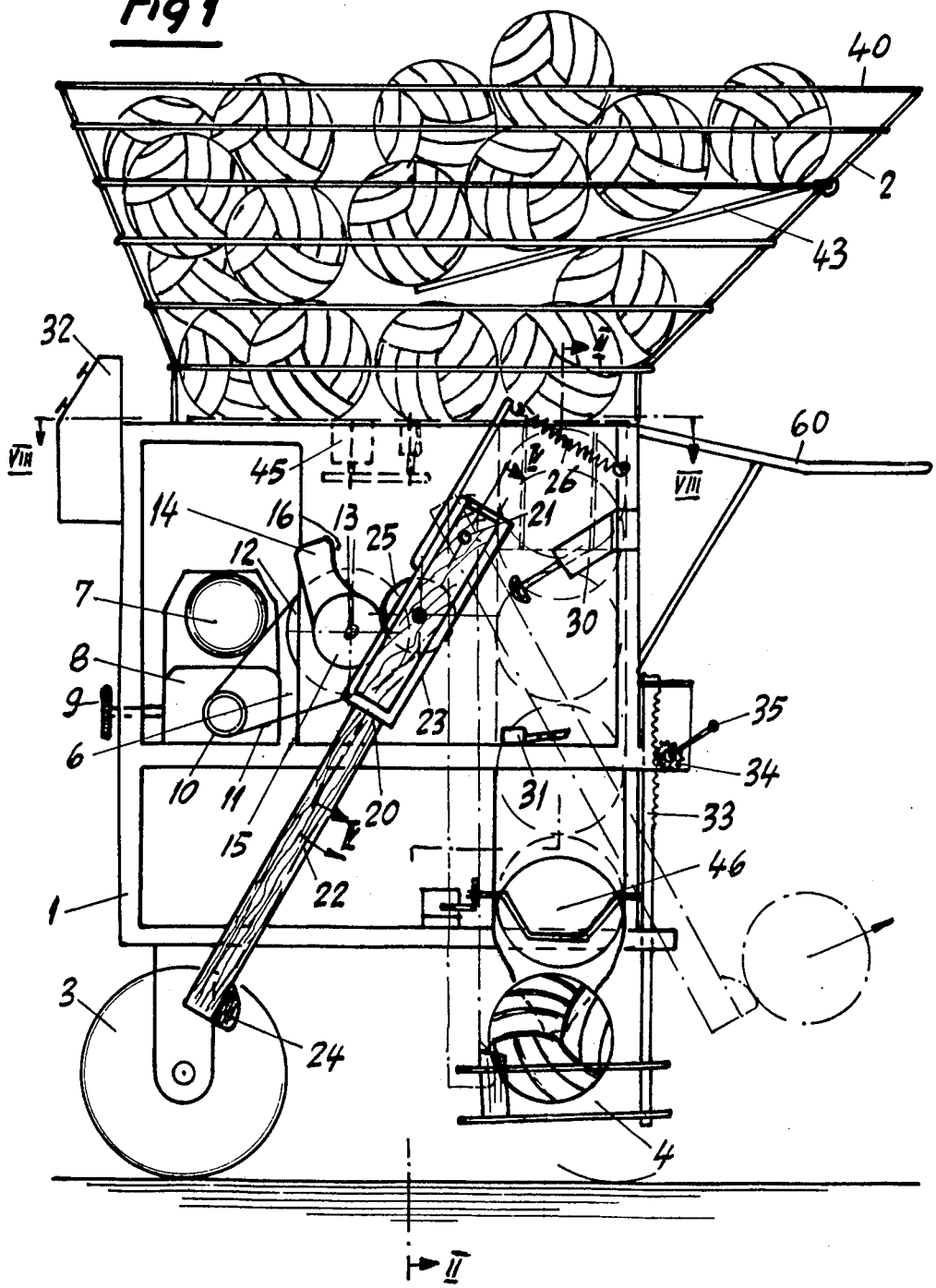
FIG. 1 is a general representation of a ball shooting apparatus substantially in diagrammatic form.

Reference will be made first of all to FIG. 1. The complete ball shooting apparatus comprises basically a frame 1 and a ball container 2. The unit is mounted for movement of wheels 3. But to simplify the drawings only one wheel has been shown.

The shooting or projecting station 4 is at the lower right in the illustration, only slightly above the ground level line 5. The striking means 6 includes the following main elements: a motor 7, a transmission 8 which is infinitely variable by adjustment by means of a hand wheel 9, a belt pulley 10, a belt 11 and a belt pulley 12 preferably constructed as a flywheel. The belt pulley 12 is connected rigidly by way of shaft 13 to a cam disc 14. The cam disc 14 is preceded by a circular idler element 15. In the constructional form described, a good impact effect is obtained if the cam disc is provided with an external, approximately radially projecting surface portion 16 which is for the optimum effect within the range of angle designated as 17 (in FIG. 9). The principal main element of the striking means 6 is a striking bar 20 which at its external upper end portion is mounted on a horizontal shaft 21. The striking bar itself comprises a wooden leg portion 22 and a metal holder 23 and hence is of insubstantial mass and of some resiliency. The leg can of course be made of other materials such as plastics material or light metal, but it should avoid the presence of excessively large hammer-like masses at the external end of the striking bar 20. At the lower end, the striking bar 20 has a striking shoe 24 which is preferably made of relatively hard rubber. Overall the striking bar 20 is about 85 cm in length.

Figure 4:
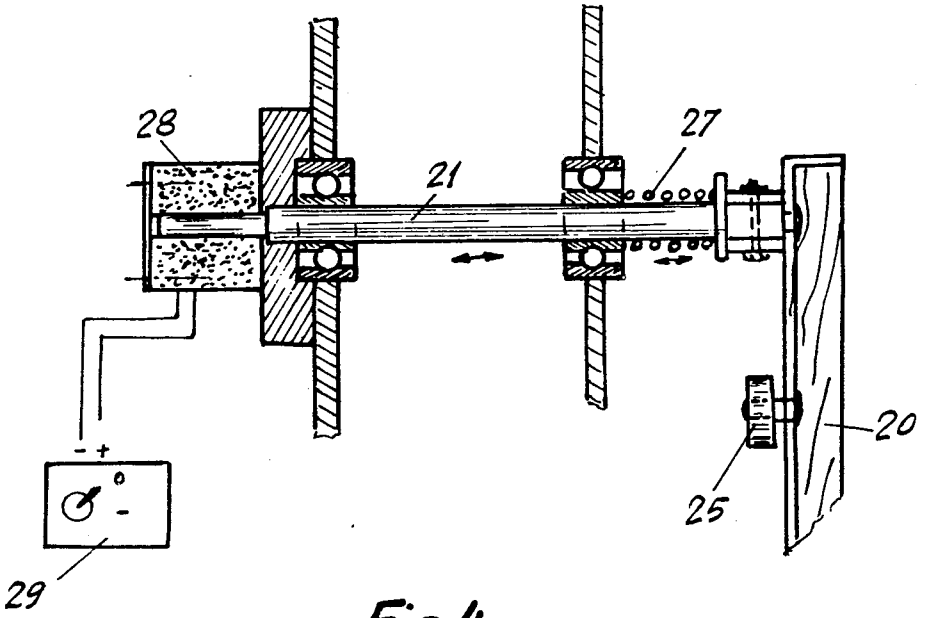
FIG. 4 shows a section taken on line IV—IV of FIG. 1.

Secured on the upper portion of the striking bar 20 is a roller 25 (FIG. 4). When the striking bar 20 is not in action it is pushed outwards (it is shown in the inner position in FIG. 4) so that the roller 25 rolls directly on the idler element 15 while motor 7 and transmission 8 drive the shaft 13, and a return spring 26 holds the striking bar in this inoperative position.

The shaft 21 is held in the external position in FIG. 4 by a compression spring 27. When the circuit of an electromagnet 28 is closed at the switch 29 the shaft 21 is drawn with the striking bar 20 and the roller 25 inwards into the rotational circle of the cam disc 14 so that the cam initiates a shooting operation when the cam disc 14 rotates.

When the striking bar 20, or striking shoe 24, has already pivoted beyond the vertical position it strikes against the football and follows the football for some distance depending on the strength of the impact or the rotational speed of the cam disc 14. On the one hand the striking bar is stopped by a damping element 30 and prevented from jumping back directly by a catch 31 which can be moved in and out by its associated electro magnetic means. The catch 31 is withdrawn again only when the striking bar with the shaft 21 is pushed again into the outer position and the roller 25 has been brought into the rotational circle of the idler element 15. But of course it is also possible to control all the sequences so that they merge into one another. Instead of the catch it is also possible to arrange an electrical control button adapted to be operated by the striking bar and controlling the pushing of the shaft 21 to the outer position. Both the switch 29 and also the electrically operated catch 31 are connected to a control unit 32 which regulates the individual sequences of operation. Naturally it is also possible for the rotational speed adjustment of the transmission 8 to be carried out purely electrically and to provide for adjustment by a suitable control element at the control unit 32. It is simply a question of convenience whether or not a cable is even connected from the control unit 32 for remote operation by the player so that the player can himself adjust the ball deliveries for example as regards strength of shot and frequency, so that he does not have to leave his practise station. The frequency of the shots can also be controlled by a clockwork mechanism and subjected to individual control, for example delayed action. Of course the shooting station 4 can also be adjusted in the vertical direction by motor means and thus also remote controlled.

In the illustrated constructional example the shooting station 4 can be adjusted by means of a draw rod 33 by means of a toothed wheel 34 with crank 35, so that the shooting angle can be adjusted.

Figures 5, 6, 7:
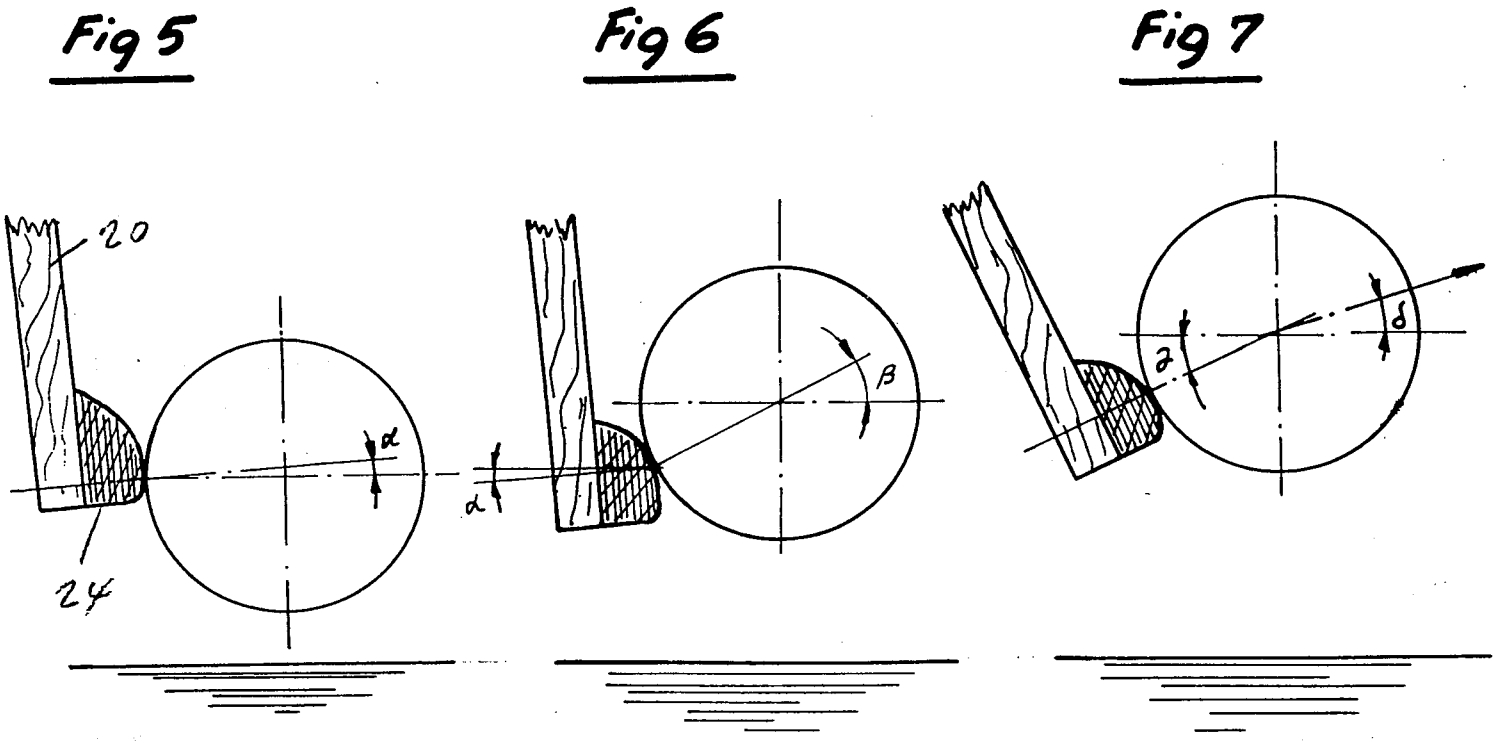
FIG. 5 shows the position of the striking shoe relatively to the ball for a horizontal shot or toe kick.
FIG. 6 shows a shooting position for a cross shot at the beginning, and FIG. 7 the position wherein the football is leaving the striking shoe.

FIG. 5 shows approximately the lowest position for the football relatively to the striking shoe 24 for a horizontal shot.

FIG. 6 shows the football raised a few centimeters as compared with FIG. 5. Already when the striking shoe 24 strikes the ball, the striking force is directed obliquely upwards by an angle $\alpha$. The striking force in this case strikes through the ball centre point at an angle $\beta$ of about 30° relatively to the horizontal.

FIG. 7 shows the outermost position of the striking shoe 24 of FIG. 6 in which the ball leaves the striking shoe 24. The angle at which the ball is shot in the illustrated example is not quite the same as the angle $\gamma$ of the direction of the striking force, but rather an angle $\delta$ somewhat smaller than $\gamma$ since very many influencing factors such as the elasticity of the ball, the elasticity of the striking bar 20 etc. also come into play. However very high consistency of aim was achieved with a first prototype ball shooting apparatus and it was found that adjustment values obtained by trial and error are quite sufficient for practical use.

The ball container 2 is made from thin iron section members 40 and has a capacity for a large number of footballs, for example 20–50 footballs. However the ball shooting apparatus can be used e.g. with as few as four or five balls. But this simply is a question of convenience to avoid the need for another person constantly to replace balls.

As FIG. 8 shows, a rotating five-armed star-shaped element 41 is arranged in the ball container 2. It is mounted a short distance above the floor of the container. Directly above an opening 42 several guard rails 43 are mounted so that a football pushed by the star-shaped element 41 mechanically to in front of the opening 42 is not blocked by footballs situated above, and can fall without hindrance through the opening 42 into the connecting tube 44 situated below. The upper portion of the connecting tube 44 is formed by rods so that from a distance it is possible to see when the last ball has been taken from the ball container 2.

The star-shaped element 41 is controlled by means of a drive 45 which is preferably controlled only intermittently in step with the other operations by the control unit 32.

The connecting tube 44 as is shown in FIG. 2 comprises at its lower mouth 46 a ball placing device 47. In the illustrated construction a simple solution has been found very advantageous. From the connecting tube 44 the footballs are let down individually, also under control of the control tube 32, by lifting a holding arm 54 for a short space of time, namely being let down into the shooting station 4 which is constructed as a channel 53. The channel 53 comprises two side walls 48 which are inclined at about 45° and which provide two supporting points 49 and 50 for the football. The third supporting point 51 which is also below the ball centre is provided by the plate 52 welded-on obliquely on the side wall 48. As FIG. 1 shows, the channel 53 is inclined slightly towards the rear. An individual ball released by the holding arm 54 rolls into the channel 53 and very quickly rests on the three supporting points 49,50 and 51 and in this way is positioned very accurately for the striking shoe 24. For shots at a high rate of frequency, the ball placing device can be constructed with a mechanism whereby the ball is placed by jaws directly on the supporting points. In this way bouncing of the ball is prevented.

The holding arm 54 is operated at the desired rate by means of a link 56 secured to a common pivot 55, the link being actuated by way of a connecting rod 57 from an electromagnet 58. The rate is synchronised with the other movements by the control unit 32.

As FIG. 1 shows, the entire ball shooting apparatus is constructed as a carriage which can be pushed by a handle 60 and can also be turned in any desired direction. In actual use, most frequently the carriage will be placed in a position which is appropriate to the desired target and after adjusting the necessary striking force, by adjusting the rotational speed of the transmission 8, the shot angle by vertical adjustment of the shooting station 4, one or two test shots will be delivered. Usually small subsequent corrections will be required, and then the series of practice shots can be played through by manual triggering with a simple apparatus.

If a relatively long series of very hard shots is required, it may be necessary to anchor the ball shooting apparatus to the ground. The carriage is preferably constructed as a three-wheeler with the single wheel steerable.

Figure 9:
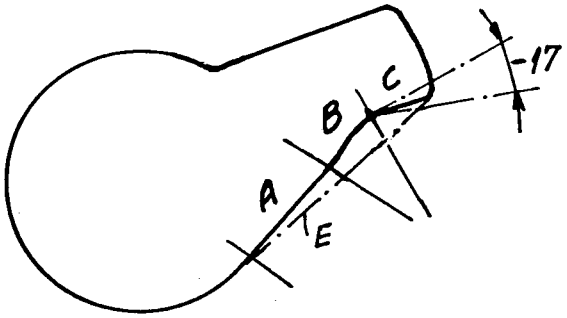
FIG. 9 shows the cam disc on a larger scale.

In FIG. 9 the cam disc is shown on a larger scale. Good results can be obtained if the cam disc 14 is given a simple form as is shown by the broken line E. But particularly good shots are obtained if the operative parts of the cam disc 14 have an acceleration cam portion A and an actual striking cam portion C. Depending on particular conditions, the cam disc can be adjusted relatively to the striking bar 20 so that the end of the acceleration cam portion A coincides with the striking of the striking bar against the ball. But a stronger shot is obtained if the transition portion B is in engagement with the roller 25 already before the striking bar strikes against the ball, so that when the striking shoe 24 hits against the ball the striking force can already be profitably used, and a more sustained impact produced.

It has been found very advantageous more particularly for powerful shots if the striking shoe follows the football by a distance equivalent to about the length of a shoe or even more in order to maintain the impact on the ball over this distance. The acceleration path of the striking bar 20 or the striking shoe 24 in the construction illustrated in FIG. 1 amount to more than a foot length.

In actual practice it is of great advantage to arrange all the control elements at the side of the ball shooting apparatus remote from the shooting direction, so that an operator can immediately see the result of the shot and can correct the setting.

What I claim and desire to secure by Letters Patent is:

1. Apparatus for shooting a football, comprising: a ball container adapted to contain a plurality of footballs, means defining a ball shooting station, transfer means for the transfer of balls one at a time from said container to said shooting station, striking means for striking a ball located at said shooting station, said striking means having ball engaging means that impacts against a ball to immediately propel a football through the air, adjustment means for adjusting the strength of the force with which said striking means strikes said ball, and position selection means for selecting the position of the point of impact of said striking force against said ball, said striking means comprising a striking bar and means for mechanically engaging and driving said striking bar in the shooting direction, said striking bar being mounted near its upper end on a horizontal pivot for pivoting movements in a vertical plane, said striking bar striking said ball at the lower end of the bar and in the general area of the lowest point of the swinging movement of the bar, said shooting station including determining support points to determine the position of said ball at said shooting station, said shooting station being in proximity to the ground, said mechanical driving means including positively driven means for abuttingly engaging said striking bar to accelerate said striking bar to initiate a shot and impact said striking bar against said ball with a striking force, and, after impact, continuing to apply said striking force to said ball to provide follow-through, whereby said ball is projected in a selected direction with desired strength.

2. Apparatus as claimed in claim 1, wherein the position selection means comprises adjusting means for the shooting station such that the striking force is directed against said ball in a direction selected from within a range extending from the horizontal to one that is upwardly inclined, and wherein the point of impact of said striking force against said ball is selected from within a range along the circumference of the ball encompassed by the horizontal plane passing through the center point of said ball and a plane passing through said center point and forming an angle of more than 30° with said horizontal plane from a downward direction.

3. Apparatus as claimed in claim 1 further comprising ball release means for releasing a said ball individually to go to said shooting station, shot initiating means for initiating an operative shot by said striking means, and central control means including controls in close proximity to each other for controlling said ball release means and said shot initiating means.

4. Apparatus as claimed in claim 1 wherein said shooting station includes three location determining support points to determine the position of said ball at said shooting station, said support points being so disposed relative to each other as to locate said ball from below a horizontal plane passing through the center point of said ball.

5. Apparatus as claimed in claim 4 wherein two of said three support points are formed along two respective guide members, said guide members being downwardly inclined with respect to said third support point and toward said striking means.

6. Apparatus as claimed in claim 1 wherein said striking bar is of a length within the range of 70 cm to 100 cm, said striking bar being made of a wood-like material that is of inconsiderable mass and resilient, said striking bar having a striking shoe at its lower end, said shoe being rounded as seen in vertical elevation toward said point of impact.

7. Apparatus as claimed in claim 1 wherein said means for mechanically engaging and driving said striking bar includes cam means and drive means for driving said cam means, and engagement means for bringing said cam means into engagement with said striking bar to move said striking bar in a shooting direction to initiate a shot.

8. Apparatus as claimed in claim 7 wherein said cam means comprises a cam disc having a first cam portion for initially accelerating said striking bar in the shooting direction and a second cam portion the operative surface of which is substantially straight and deviates not more than 15° from the radial direction of said cam disc so as to be operative during and after impact for continuing to apply striking force to said ball to provide a follow-through.

9. Apparatus as claimed in claim 7 wherein said drive means has speed variation means whereby the speed of rotation of said cam means can be varied to produce different rates of acceleration of said striking bar and hence shots of different strengths.

10. Apparatus as claimed in claim 1 wherein said ball container is disposed above said shooting station, and said transfer means between said ball container and said shooting station is in the form of a connecting tube 11. Apparatus as claimed in claim 10 wherein said ball container comprises a flat floor with an opening therein leading to said connecting tube.

12. Apparatus as claimed in claim 11, the said ball container comprising a rotary feeder element above said floor to feed said balls toward said opening, said rotary feeder having an intermittent drive.

13. Apparatus as claimed in claim 12 wherein said ball container comprises guard rails mounted above the opening of the floor, so that a foot ball pushed in front of the opening is not blocked by foot balls situated above.

14. Apparatus as claimed in claim 1 wherein said means for mechanically engaging and driving said striking bar comprises rotatably driven cam means for initially engaging and driving said striking bar in the shooting direction so as to impact said striking bar against said ball, and continuing to engage and drive said striking bar against said ball after impact and beyond said shooting station.

15. Apparatus as claimed in claim 14 wherein the pivot axis of said striking bar and the rotational axis of said cam means are parallel, and said striking bar and said cam means are relatively displaceable axially so as to bring said striking bar selectively into or out of the turning circle of said cam means.

16. Apparatus as claimed in claim 1 further comprising ball release means for releasing a ball individually to go to said shooting station, shot initiating means for initiating an operative shot by said striking means, central control means including controls in close proximity to each other for controlling said ball release means and said shot initiating means, said shooting station having height adjustment means for varying the vertical position of said shooting station relative to said striking means thereby to vary the point of impact of said striking means against said ball, said shooting station including three location determining support points to determine the position of said ball at said shooting station, said support points being so disposed relative to each other as to locate said ball from below a horizontal plane passing through the center point of said ball, two of said three support points being formed along two respective guide members forming part of a generally V-shaped channel, said guide members being downwardly inclined with respect to said third support point and toward said striking means so as to position said ball only a short distance above the ground, said striking bar being of a length within the range of 70 cm to 100 cm, said striking bar being made of a wood-like material that is of inconsiderable mass and resilient, said striking bar having a striking shoe at its lower end, said shoe being rounded as seen in vertical elevation toward said point of impact, said striking shoe being disposed near the lower end of said striking bar, said striking means further comprising a roller secured to said striking bar, cam means and drive means for driving said cam means, engagement means for bringing said cam means into engagement with said striking bar by way of said roller to initiate a shot, said cam means comprising a cam disc having a first cam portion for accelerating said striking bar and a second cam portion the operative surface of which is substantially straight and deviates not more than 15° from the radial direction of said cam disc so as to be operative during and after impact for continuing to apply striking force to said ball to provide a follow-through, the pivot axis of said striking bar and the rotational axis of said cam disc being parallel and said cam disc and said striking bar being displaceable axially relative to one another whereby upon continuous rotation of the cam disc it can be relatively displaced so that said roller of said striking bar is selectively in or out of the turning circle of said cam disc and hence selectively brought into or out of engagement therewith, said drive means having speed variation means whereby the speed of rotation of said cam disc can be varied steplessly to produce different rates of acceleration of the striking bar and hence shots of different strengths, said ball container being disposed above said shooting station and said transfer means between said ball container and said shooting station being in the form of a connecting tube, said ball container comprising a flat floor with an opening therein leading to said connecting tube and a rotary feeding element above said floor to feed said balls toward said opening, and said rotary feeder having an intermittent drive.

* * * * *